United States Patent [19]

Miller

[11] 4,349,040

[45] Sep. 14, 1982

[54] FOLDING POOL CANOPY

[76] Inventor: Richard L. Miller, 3612 Woolworth Bldg., 233 Broadway, New York, N.Y. 10007

[21] Appl. No.: 181,117

[22] Filed: Aug. 25, 1980

[51] Int. Cl.[3] ..... E04F 10/10

[52] U.S. Cl. ..... 135/5 R; 135/7.1 R

[58] Field of Search ..... 135/5 R, 4 R, 7.1 R

[56] References Cited

U.S. PATENT DOCUMENTS

| | | | |
|---|---|---|---|
| 706,605 | 8/1902 | Slyder | 135/5 R |
| 2,547,770 | 4/1951 | Pelton | 135/5 R |

FOREIGN PATENT DOCUMENTS

| | | | |
|---|---|---|---|
| 178528 | 9/1955 | Netherlands | 135/7.1 R |

*Primary Examiner*—J. Karl Bell

*Attorney, Agent, or Firm*—Richard L. Miller

[57] ABSTRACT

A swimming pool cover including a canopy supported by a foldable framework of support struts, the swimming pool cover being novel by including rotatable support struts so that, among other uses, selected segments of the swimming pool may be uncovered thereby allowing safe and convenient access for, use inspection, cleaning or repair.

4 Claims, 8 Drawing Figures

FOLDING POOL CANOPY

BACKGROUND OF THE INVENTION

This invention relates generally to canopies such as are used to cover and protect swimming pools.

SUMMARY OF THE INVENTION

A principal object of the instant invention is to provide a pool cover safe for people and animals while allowing convenient access to certain portions of the pool while the pool remains covered.

Another object is to provide a pool cover which will keep it free from foreign objects such as dirt and leaves.

Yet another object is to help control water temperature, conserve energy for heated pools by retaining heat and controlling water lost through evaporation.

Other objects are to provide a pool cover which is simple in design compatible with most pools, inexpensive to manufacture, rugged in construction, easy to use and efficient in operation.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Further objects, features and advantages of the invention will become apparent upon consideration of the following detailed description in conjunction with the drawings.

BRIEF DESCRIPTION OF THE DRAWING FIGURES

DETAILED DESCRIPTION OF THE PREFERRED EMBODIMENT

Figure 2:
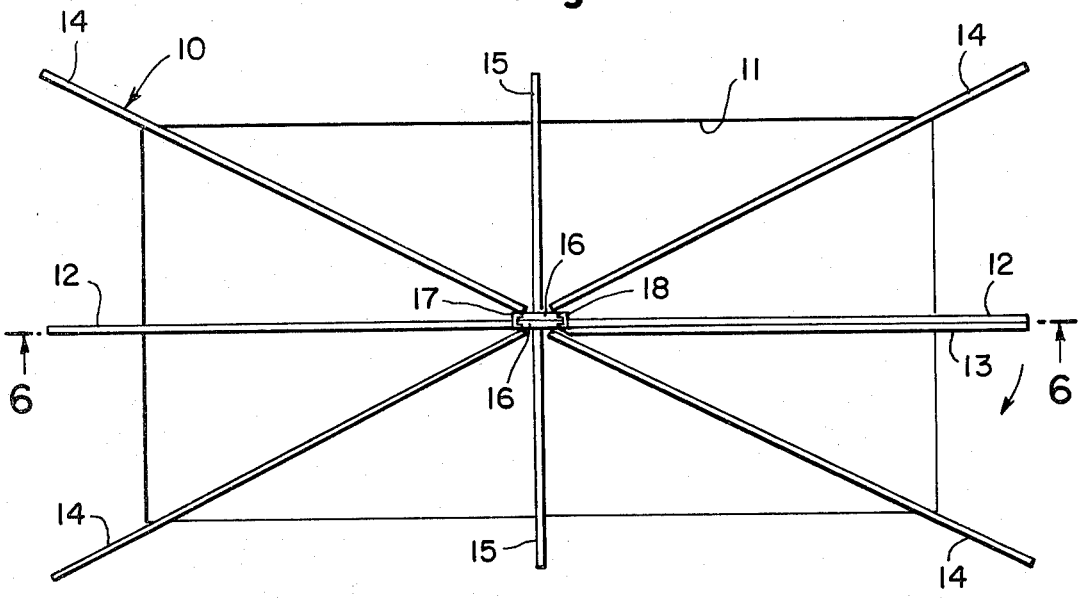
FIG. 2 is a top view of the canopy mounted over a rectangular swimming pool.

Referring now to the drawings in detail, FIG. 2 shows the canopy 10 mounted over a rectangular swimming pool 11 with each of its nine (9) support struts 12, 13, 14 and 15 radiating from the two (2) center plates 16, two (2) center plate locks 17, 18.

Figure 3:
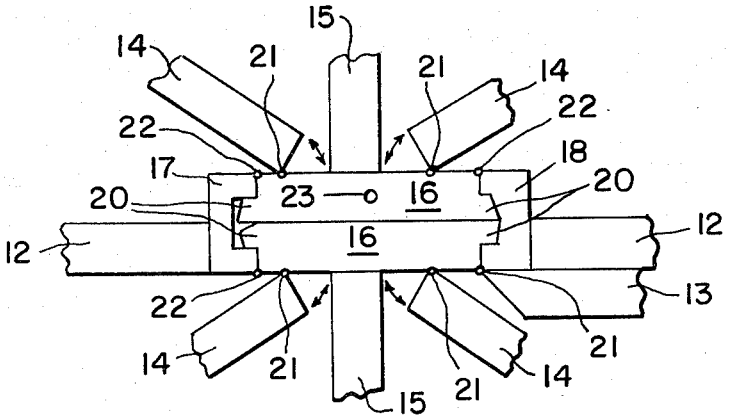
FIG. 3 is an enlarged partial top view depicting detail of center plates with protrusions, center plate locks and radiating canopy support struts in errect or open for use position.

FIG. 3 shows a detailed top view of center plates 16 with protrusions 20, center plate support struts 15, center plate rotatable support struts 13, 14 with center plate rotatable support strut pivot means 21, U-shaped center plate locks 17, 18, center plate lock pivot means 22, center plate lock struts 12 and mounting receptacle 23.

Figure 1:
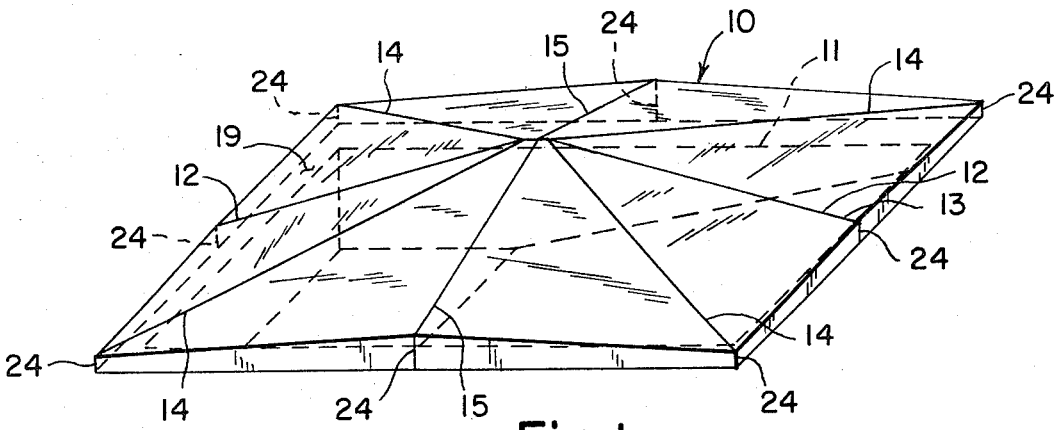
FIG. 1 is a perspective view depicting the canopy mounted over a rectangular swimming pool.

When the canopy 10 is covering a pool illustrated in FIGS. 1 and 2 the center plates 16 are positioned face to face and held together by the U-shaped center plate locks 17, 18 which fit over and around the center plate protrusions 20 of center plates 16. When the center plates 16 are locked together the center plate struts 15 and the center plate lock struts 12 are perpendicular to each other.

The rotatable support struts 14 are secured to the center plates 16 by the rotatable support strut pivot means 21 so that said rotatable support struts 14 may be moved from a position parallel to center plate support strut 15 to a position parallel to the center plate lock struts 12. The range of motion for rotatable support strut 14 and adjacent rotatable support strut 13 is limited due to their proximity. The range of motion which rotatable support struts 13 and 14 offer allows selective access to segments of the swimming pool 11 for use, inspection, cleaning or repair.

Figure 4:
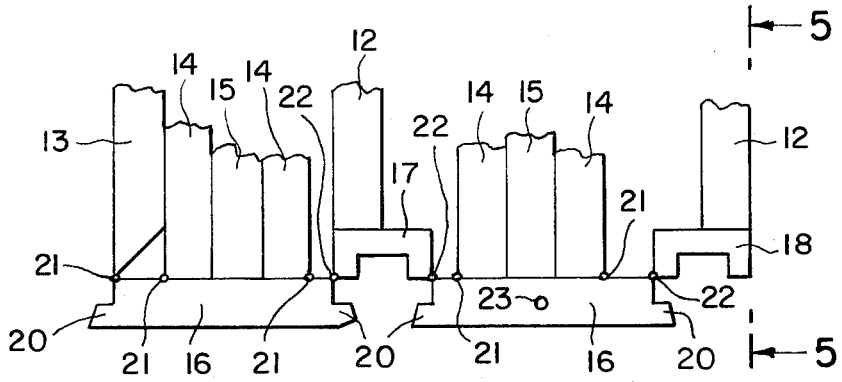
FIG. 4 is an enlarged partial top view of the canopy in folded or collapsed position.

FIG. 4 shows the center plates 16 unlocked and the support struts 12, 13, 14 and 15 folded together for storage.

The center plate lock 17 joining the center plates 16 has two (2) center plate lock pivot means 22 while the remaining center plate lock 18 has only one (1) center plate lock pivot means 22. When the canopy 10 is to be opened and the center plates 16 are placed face to face the center plate lock 17 joining the center plates 16 will conform to the contour of the center plate protrusions 20. Having only one (1) center plate lock pivot means 22 said remaining center plate lock 18 will likewise conform to the contour of the center plate protrusions 20 by being frictionally fitted thereto.

Figure 5:
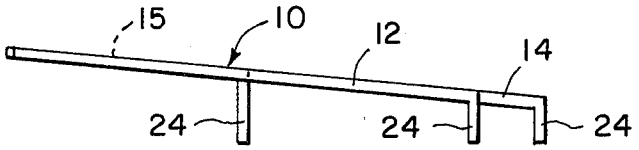
FIG. 5 is a side view on line 5—5 of FIG. 4 folded up.

FIG. 5 shows a side view of the canopy 10 in a folded position illustrating the three (3) different strut lengths 12, 14 and 15 required to span a rectangular swimming pool. The center plate strut 15 is the shortest and spans only half of the width of the pool. The center plate lock strut 12 is the next in length spanning half the length of the pool and the rotatable strut 14 is the longest spanning half the diagonal length of the pool. Rotatable support strut 13 is the same length as center plate lock strut 12 which is parallel thereto. Each strut regardless of length has a leg 24 upon which, in combination, the canopy stands.

Figure 6:
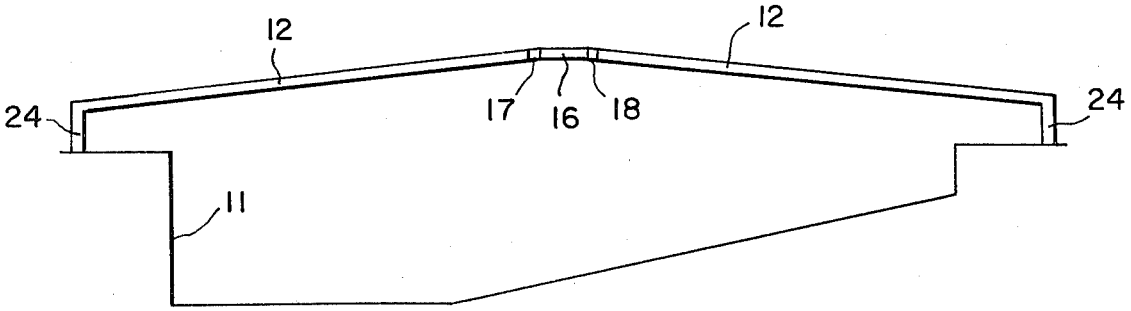
FIG. 6 is a cross-sectional side view of a center plate, center plate locks and canopy support struts on line 6—6 of FIG. 2.
Figure 7:
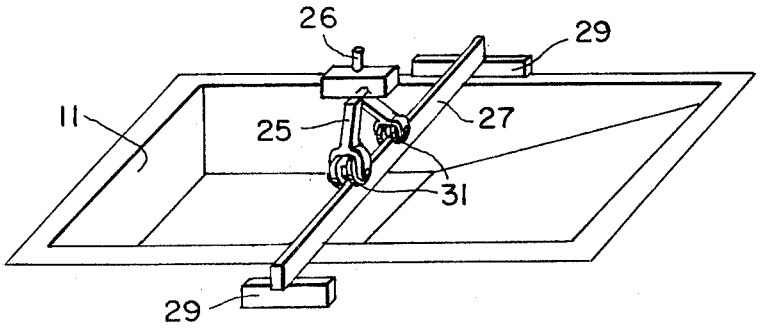
FIG. 7 is a perspective view depicting a preferred canopy positioning method.

FIG. 6 shows a cross-sectional side view of one (1) center plate 16 with center plate locks 17, 18 and center plate lock struts 12 spanning the length of a rectangular swimming pool 11.

All of the canopy support struts 12, 13, 14 and 15 radiate downwardly and away from the center plates 16 and center plate lock 17, 18 to which said struts are secured. Also shown is the vertical position of the strut leg 24 attached to and part of each support strut 12, 13, 14 and 15. The strut legs 24 are vertical relative to the surface area around the pool 11 upon which the canopy 10 stands.

FIG. 1 shows the canopy 10 mounted over a rectangular swimming pool 11 with each of its nine (9) support struts 12, 13, 14 and 15 radiating down and away from the two (2) center plates 16 and two (2) center plate locks 17, 18 illustrated in FIGS. 2, 3, 4 and 6. FIG. 1 also shows flexible material 19. Each pair of adjacent canopy support struts (13 and 14, 14 and 15, 12 and 14) has a triangular section of flexible material 19 attached to and between each said pair of struts except there is no material between rotatable strut 13 and parallel center plate lock 12.

The canopy 10 may be opened by moving rotatable strut 13 away from center plate lock strut 12. Similarly other sections of the canopy 10 may be opened by moving adjacent rotatable struts 14 and 15, 14 and 12. In this fashion the canopy provides a safe durable cover to swimming pools while allowing selective access thereto.

When the canopy is opened so that less than half of the pool area is exposed the structure remains stable but when collapsed so that more than half of the pool's area is exposed the structure will then tip so that it's center will fall into the pool. To prevent this from occurring, beam 27 mounted upon a suitable support structure 29 at each end spans the width of the pool 11.

A trolley structure 25 provision with wheels 31 to ride along the length of the beam is fitted with a pin 26. A corresponding receptacle opening 23 is located in one of center plates 16.

When it is required to collapse or erect the canopy and expose more than half the pool's surface area the trolley and beam structure are located at a suitable position over the pool.

Pin 26 is inserted in the corresponding opening 23 of the center lock 16 and in this way the center of the canopy is supported when it would otherwise be unstable. When erecting the canopy from a collapsed state the trolley is first positioned at one end of the beam and as the canopy is unfolded its center is rolled on the trolley toward the center of the pool.

Figure 8:
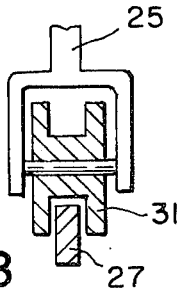
FIG. 8 is an enlarged cross-sectional view of trolley wheel and support beam.

The wheels 31 of the trolley are grooved as illustrated in FIG. 8 so that the trolley cannot fall or tip side way off the beam.

After the canopy is erected or collapsed as the case may be the trolley and beam are to be removed from the cite so that the entire surface of the pool is free of obstacles.

What is claimed is:

1. A folding pool canopy apparatus, in combination, comprising:

a central support means including a pair of center plates rotatably connected and a pair of center plate locking means each rotatably connected to one of said center plates, a first pair of support struts connected to each of said center plates, a second pair of support struts connected to each of said center plate locking means, a plurality of support struts rotatably connected to said pair of center plates, a flexible covering connected to said support struts, and means for supporting the ends of said support struts, said apparatus being movable between mounted and folded positions, wherein in said mounted position said center plates are positioned face to face, said center plate locking means are positioned at opposite ends of said center plates, said center plate locking means being for removably locking said center plates in said face to face position, said first and second pairs of support struts extend radially outwards from said central support means approximately perpendicular to one another, and said support struts radiate outwardly from said central support means; and in said folded position said center plates are positioned in-line, said center plate locks are positioned at opposite ends of said in-line center plates, and said support struts are parallel to one another and perpendicular to said in-line center plates.

2. A folding pool canopy as recited in claim 1, further including means for supporting said canopy between said folded and said mounted positions, said means for supporting for then including a beam extending across said pool, means for supporting said beam, trolley structure means having wheels adapted to ride along said beam, a pin extending upwards from said trolley structure means, and a receptacle in one of said center plates for removably receiving said pin.

3. A folding pool canopy apparatus as recited in claim 2, further including an extra support strut rotatably connected to one of said center plates, said apparatus being devoid of said flexible material between said extra strut and one of said pairs of support struts, said extra support strut being movable between said mounted and folded positions and capable of being positioned adjacent to one of said support struts in said mounted position and parallel to said support struts in said folded position, said extra support strut also being capable of being rotated between adjoining said support struts, whereby said extra support strut can be rotated in the mounted position to provide access to the covered pool.

4. A folding pool canopy apparatus as recited in claim 3, wherein said support struts are inclined downwards from said central support means to said means for supporting.

* * * * *